US007704048B2

(12) United States Patent
Liang

(10) Patent No.: US 7,704,048 B2
(45) Date of Patent: Apr. 27, 2010

(54) TURBINE AIRFOIL WITH CONTROLLED AREA COOLING ARRANGEMENT

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 595 days.

(21) Appl. No.: 11/639,959

(22) Filed: Dec. 15, 2006

(65) Prior Publication Data

US 2009/0324423 A1 Dec. 31, 2009

(51) Int. Cl.
*F01D 5/18* (2006.01)

(52) U.S. Cl. ..... 416/97 R; 415/115

(58) Field of Classification Search ..... 416/97 R, 416/1, 96 A, 90 R, 91; 415/115; 29/889.721
See application file for complete search history.

(56) References Cited

U.S. PATENT DOCUMENTS 4,500,258 A * 2/1985 Dodd et al. ..... 416/97 R
4,992,026 A * 2/1991 Ohtomo et al. ..... 416/97 R
6,059,529 A 5/2000 Schiavo
6,533,547 B2 3/2003 Anding et al.
6,902,372 B2 6/2005 Liang
6,932,573 B2 8/2005 Liang
6,955,523 B2 10/2005 McClelland
6,971,851 B2 12/2005 Liang
6,981,846 B2 1/2006 Liang
7,008,186 B2 3/2006 Heeg et al.
7,033,136 B2 4/2006 Botrel et al.
7,063,506 B2 6/2006 Davison et al.
7,080,971 B2 7/2006 Wilson et al.
2005/0031452 A1 2/2005 Liang
2005/0244270 A1 11/2005 Liang
2005/0265835 A1 12/2005 Liang
2005/0281667 A1 12/2005 Liang
2005/0281674 A1 12/2005 Liang
2006/0002788 A1 1/2006 Liang
2006/0029497 A1 2/2006 Liang
2006/0056967 A1 3/2006 Liang

* cited by examiner

*Primary Examiner*—Richard Edgar

(57) ABSTRACT

A gas turbine airfoil (10) includes a serpentine cooling path (32) with a plurality of channels (34,42,44) fluidly interconnected by a plurality of turns (38,40) for cooling the airfoil wall material. A splitter component (50) is positioned within at least one of the channels to bifurcate the channel into a pressure-side channel (46) passing in between the outer wall (28) and the inner wall (30) of the pressure side (24) and a suction-side channel (48) passing in between the outer wall (28) and the inner wall (30) of the suction side (26) longitudinally downstream of an intermediate height (52). The cross-sectional area of the pressure-side channel (46) and suction-side channel (48) are thereby controlled in spite of an increasing cross-sectional area of the airfoil along its longitudinal length, ensuring a sufficiently high mach number to provide a desired degree of cooling throughout the entire length of the airfoil.

14 Claims, 2 Drawing Sheets

TURBINE AIRFOIL WITH CONTROLLED AREA COOLING ARRANGEMENT

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The present invention relates to the field of turbine vanes, and more particularly, the present invention relates to turbine vanes having cooling channels for passing cooling fluids to cool the turbine vanes.

BACKGROUND OF THE INVENTION

Gas turbine engines include a compressor for compressing air, a combustor for mixing the compressed air with fuel and igniting the mixture, and a turbine assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for additional thermal protection.

Typically, turbine vanes are formed from an elongated portion forming an airfoil having one end configured to be coupled to a vane carrier and an opposite end configured to be movably coupled to an inner endwall. The turbine vane is ordinarily composed of a leading edge, a trailing edge, a suction side, and a pressure side. Additionally, the turbine vane includes an outer diameter endwall at a first end and an inner diameter endwall at a second end. The inner aspects of most turbine vanes typically contain an intricate maze of cooling circuits forming a cooling system. These cooling circuits in the vanes receive air from the compressor of the turbine engine and pass the air through the ends of the vane adapted to be coupled to the vane carrier. The cooling circuits often include multiple flow paths that are designed to maintain all areas of the turbine vane at a relatively uniform temperature. At least some of the air passing through these cooling circuits may be exhausted through orifices in the wall of the vane.

U.S. Pat. No. 6,955,523 to McClelland discloses such a cooling circuit including a serpentine network of channels passing between the suction and pressure sides of the turbine vane, where each channel extends between turns of the serpentine network positioned at the inner diameter and outer diameter endwalls.

U.S. Patent Application Publication No. 2005/0244270 to the inventor of the present invention, discloses a cooling circuit for a turbine blade including channels within the suction and pressure sides for passing cooling fluid toward the turbine blade tip at the first end for creating a counterflow to a leakage flow of combustor gases between the blade tip and an outer seal.

An additional cooling system for a turbine blade is disclosed in U.S. Patent Application Publication No. 2005/0031452, also to the inventor of the present invention, and discloses directing cooling fluid into a center cavity between the pressure and suction sides, after which the cooling fluid flows through supply orifices and into cavities within the suction and pressure walls for spiral fluid flow before exiting the turbine blade through exhaust orifices in the outer surface of the pressure and suction sides.

BRIEF DESCRIPTION OF THE DRAWINGS

The invention is explained in the following description in view of the drawings that show.

DETAILED DESCRIPTION OF THE INVENTION

Figure 1:
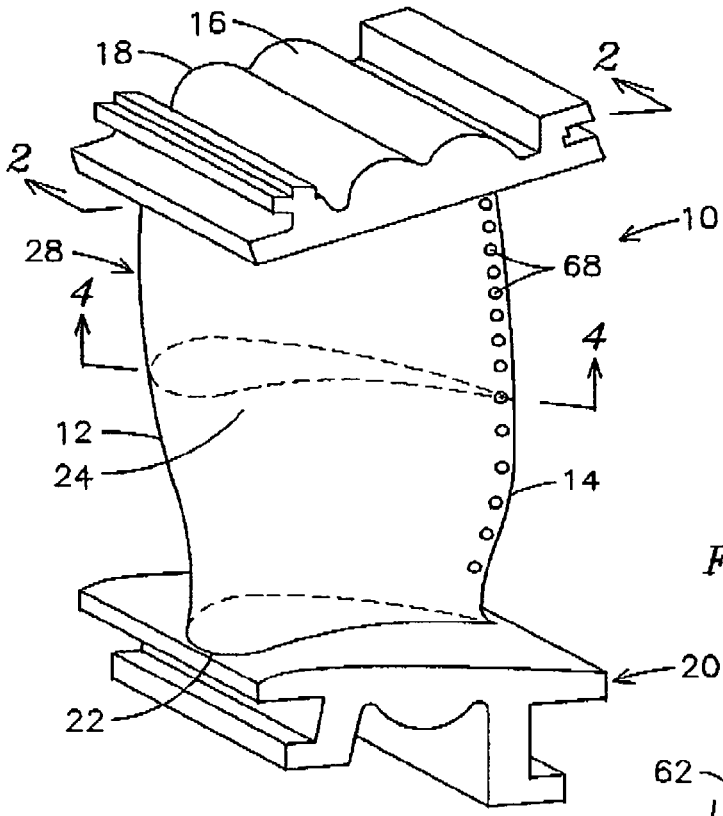
FIG. 1 is a perspective view of a turbine vane according to one embodiment of the present invention.

For certain airfoil designs having an increasing cross-sectional area along a longitudinal axis extending from an inside diameter portion to an outside diameter portion, the cooling channel structure of known serpentine cooling networks includes a large cross-sectional area increase from the inner diameter endwall to the outer diameter endwall. The present inventor has recognized that this results in a reduced cooling fluid flow rate toward the outer diameter portion of the airfoil, and that such a reduction of the fluid flow rate necessitates an over-cooling of radially inward portions of the airfoil in order to ensure adequate cooling of the radially outward portions of the airfoil.

Referring to FIGS. 1-4, a turbine vane 10 in accordance with the present invention will now be described that addresses the shortcomings of the prior art designs. The turbine vane 10 includes a cooling system 11 in inner aspects of the turbine vane 10 for use in turbine engines. While the description below focuses on a cooling system 11 in a stationary turbine vane 10, the cooling system 11 may also be used in a rotating turbine blade. The present invention is particularly useful for turbine airfoils wherein the cross-sectional area of the airfoil increases from the inside diameter endwall to the outside diameter endwall by a factor of at least 1.5:1.

The turbine vane 10 illustratively includes a leading edge 12, a trailing edge 14, an outer diameter endwall 16 at a first end 18, and an inner diameter endwall 20 at a second end 22 longitudinally opposite the first end. The turbine vane 10 further includes a generally concave shaped pressure side 24 coupling the leading edge 12 and the trailing edge 14 and a generally convex shaped suction side 26 positioned opposite from the pressure side. The pressure side 24 and the suction side 26 extend radially outward from an inner diameter at the second end 22 to an outer diameter at the first end 18. An outer wall 28 defines at least a portion of the outer surfaces of the pressure side 24 and suction side 26. An inner wall 30 is positioned relative to the outer wall on both the pressure side 24 and suction side 26.

Figure 2:
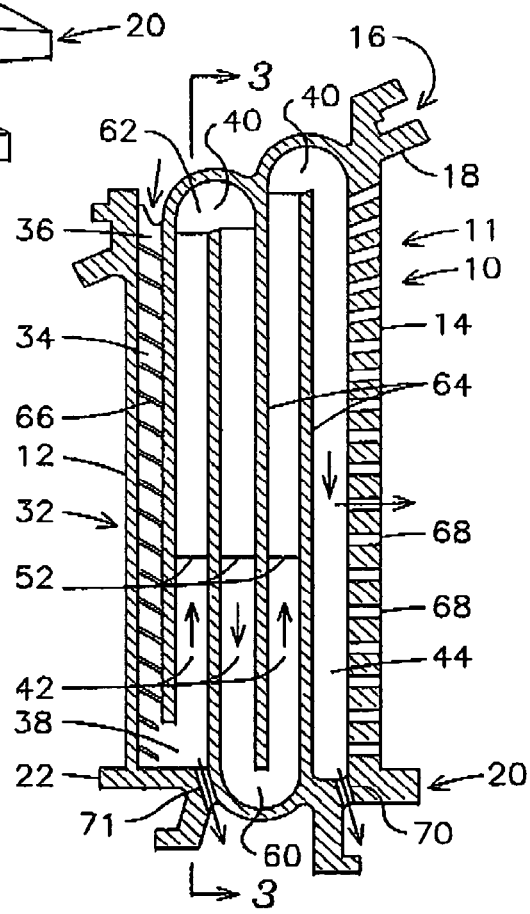
FIG. 2 is a cross-sectional view of the turbine vane of FIG. 1 taken along the line 2-2.

The cooling system 11 includes a serpentine cooling path 32 including a plurality of channels longitudinally extending from adjacent the first end 18 to adjacent the second end 22. Additionally, the serpentine cooling path 32 includes a plurality of turns 38,40 with each turn positioned adjacent to the first or second end 18, 22 for coupling consecutive channels. The plurality of channels illustratively includes an inflow channel 34 longitudinally extending adjacent the leading edge 12 from an inlet 36 adjacent the first end 18 to a first turn 38 adjacent the second end 22. Further, the plurality of channels includes a plurality of intermediate channels 42 passing in between the outer wall 28 and inner wall 30, including a first intermediate channel 42 extending between the first turn 38 and a second turn 40 adjacent the first end 18. Additionally, subsequent intermediate channels 42 similarly extend between consecutive turns 38,40 at the respective second and first end 22,18 of the turbine vane 10. The plurality of channels further include an outflow channel 44 extending adjacent the trailing edge 14 from a last turn 40 to an outlet 70 adjacent the second end 22. A rib 64 may longitudinally extend from adjacent the first end 18 to adjacent the second end 22 for separating consecutive channels of the plurality of channels. Although FIG. 2 illustrates one inflow channel 34, a plurality of intermediate channels 42 and one outflow channel 44, other arrangements may be used such as a plurality of inflow channels and outflow channels, and a single intermediate channel may be utilized in the serpentine cooling path 32. Additionally, an additional outlet 71 may be positioned adjacent the first turn 38 between the inflow channel 34 and the first intermediate channel 42.

Figure 3:
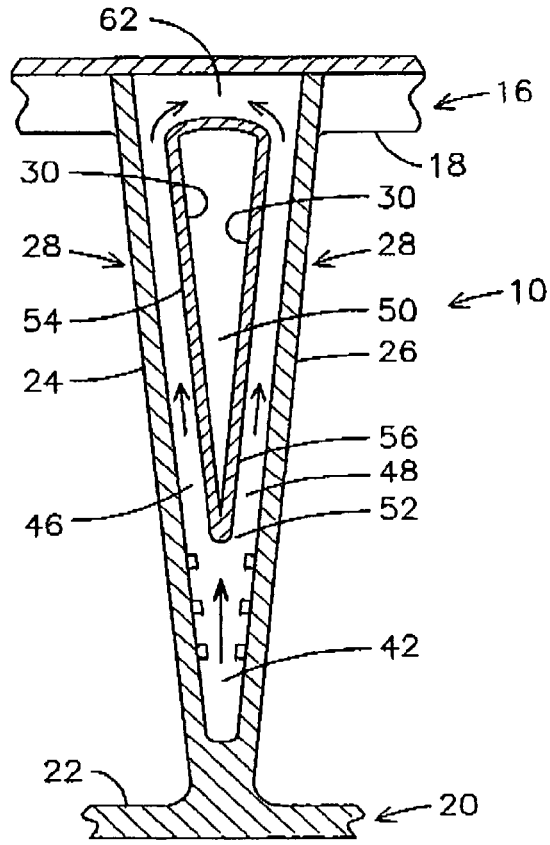
FIG. 3 is a cross-sectional view of the turbine vane of FIG. 2 taken along the line 3-3.
Figure 4:
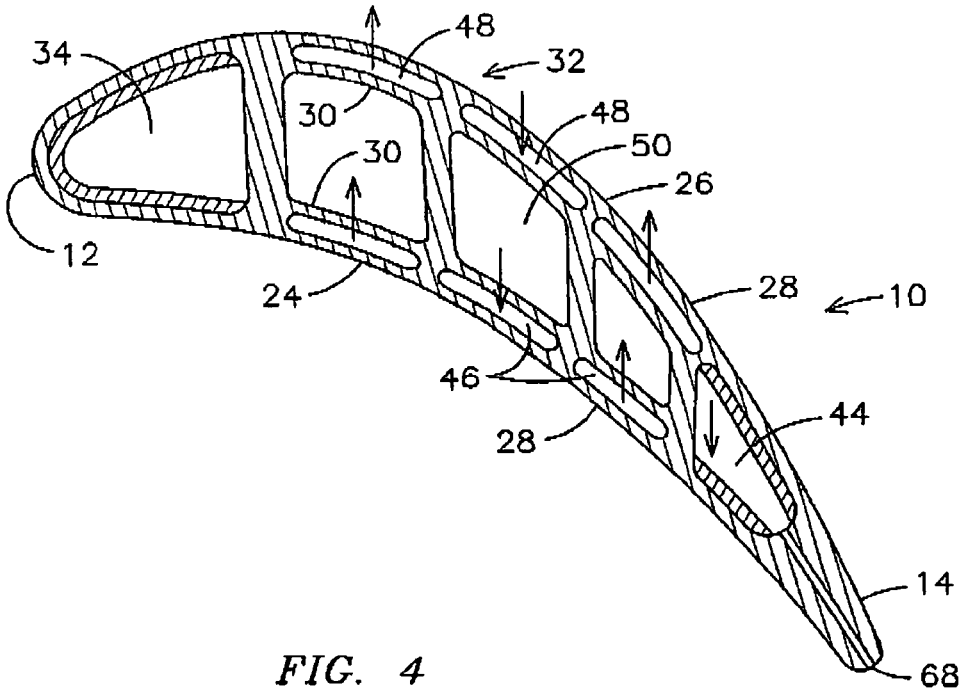
FIG. 4 is a cross-sectional view of the turbine vane of FIG. 1 taken along the line 4-4.

As may be best appreciated by viewing FIG. 3, each intermediate channel 42 extends from the second end 22 and bifurcates into a pair of intermediate channels at an intermediate height 52. The pair of intermediate channels includes a pressure-side channel 46 passing in between the outer wall 28 and the inner wall 30 of the pressure side 24 and a suction-side channel 48 passing in between the outer wall 28 and the inner wall 30 of the suction side 26. The pressure-side channel 46 and the suction-side channel 48 mutually diverge in extending to adjacent the first end 18. A splitter component 50 is positioned within each of the intermediate channels 42, and longitudinally extends from an intermediate height 52 to adjacent the first end 18. The splitter 50 divides the intermediate channel 42 into respective pair of diverging channels 46, 48. The splitter component 50 includes a pressure face 54 and suction face 56 respectively aligned with the pressure side 24 and the suction side 26. The pressure face 54 and suction face 56 mutually diverge parallel with the pressure-side channel 46 and the suction-side channel 48 from a common diverging point at the intermediate height 52 along the radial length of the vane to adjacent the first end 18. The pressure face 54 and suction face 56 bifurcate each intermediate channel 42 into the pair of intermediate channels including the pressure-side channel and suction-side channel 46, 48, thus providing a near wall cooling fluid flow along each of the pressure and suction sides at locations downstream of the intermediate height 52. The splitter component 50 may include a hollow or solid center portion between the pressure face 54 and suction face 56.

The cross-sectional flow area of each intermediate channel 42 from the second end 22 to the first end 18 is reduced by inserting the splitter component 50 into the intermediate channel. The splitter component 50 may be sized to control and regulate the cross-sectional area of the pressure-side channel 46 and the suction-side channel 48. The splitter component may be sized to minimize the variation in cross-sectional area of the pressure-side channel 46 and suction-side channel 48 along its longitudinal length. The cross-sectional flow area of the channels 46, 48 may be approximately constant from the intermediate height diverging point 52 to their respective ends, and the sum of these two flow areas may remain approximately equal to the cross-sectional flow area of the intermediate channel at the diverging point 52. A typical mach number variation of the cooling fluid flow rate through a turbine vane of the prior art may be from 0.06 to 0.02 along the length of the airfoil. Selection of the size, geometry and location of the splitter component 50 enables a designer of an airfoil of the present invention to control the variation in mach number to any desired limited range, such as from 0.06 to 0.08.

At incremental positions between the leading edge 12 and the trailing edge 14, an intermediate channel 42 is passed through the turbine vane 10 and bifurcated into a pair of intermediate channels, a pressure-side and suction-side channel 46, 48. Cooling fluid passes through the pressure-side channels and suction-side channels of adjacent incremental positions in an opposite flow direction. The number and positioning of such incremental positions of the pressure and suction-side channels 46, 48 between the leading and trailing edges 12, 14 is selectively determined so to maintain a minimum threshold flow rate of the cooling fluid through each pressure and suction-side channel so to maintain a desired cooling efficiency for the turbine vane cooling system. In an exemplary embodiment of the present invention, the minimum threshold flow rate of the cooling system may be a mach number of 0.08, for example.

Consecutive turns 38,40 for an intermediate channel 42 are positioned adjacent an inner diameter cavity 60 along the inner diameter endwall 20 and adjacent an outer diameter cavity 62 along the outer diameter endwall 16. The inner diameter cavity 60 and the outer diameter cavity 62 respectively extend adjacent the second end 22 and the first end 18 of the turbine vane 10.

A portion of the inner surface of the channels may include at least one skew trip strip 66 for increasing the heat transfer coefficient by causing turbulent flow through the respective channel.

The outflow channel 44 may include one or more cooling holes 68 along the trailing edge 14, where each of the cooling holes extends from the inner surface of the outflow channel to the outer surface of the trailing edge. The outflow channel 44 may further include one or more outlets 70 adjacent the inner diameter cavity 60, where each outlet extends from the inner surface of the inner diameter cavity to the outer surface of the inner diameter endwall. Each outlet 70 may direct used cooling fluid to a rim cavity (not shown) positioned external to the turbine vane 10.

During operation, the cooling fluid flows through the inlet 36 and into the inflow channel 34, around the first turn 38, and into a first intermediate channel 42. The cooling fluid flows toward the first end 18 and upon reaching the intermediate height 52 within the intermediate channel 42, the cooling fluid is bifurcated into a pressure-side channel 46 and a suction-side channel 48. Each of the suction-side channel and pressure-side channel 46,48 then extend to the outer diameter cavity 62 adjacent the first end 18. Within the outer diameter cavity 62, the cooling fluid traverses toward the trailing edge 14, before taking a second turn 40 into a pressure-side channel 46 and suction-side channel 48 of an adjacent intermediate channel 42. The cooling fluid passes through each of the pressure-side channel 46 and suction-side channel 48 in the direction of the second end 22, before merging at the intermediate height 52 where the splitter component 50 ends. The cooling fluid then flows within the intermediate channel 42 to the inner diameter cavity 60 adjacent the second end 22. The cooling fluid continues through the serpentine cooling path 32 in this fashion and upon taking a last turn adjacent the first end 18, enters the outflow channel 44. The cooling fluid flows toward the second end 22 and partially diffuses out the trailing edge 14 through cooling holes 68 in the trailing edge. Further, a portion of the cooling fluid flows to the second end 22 and exits out an outlet 70 to a rim cavity external to the turbine vane.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A cooling arrangement for a turbine airfoil having an increasing cross-sectional area along a longitudinal axis from an inner diameter endwall to an outer diameter endwall, the cooling arrangement comprising:

a cooling path extending in a generally longitudinal direction along the turbine airfoil, the cooling path comprising a single channel for conducting a fluid flow for cooling both a pressure side and a suction side of the turbine airfoil proximate the inner diameter endwall; and a splitter component disposed within the cooling path and extending from a diverging point toward the outer diameter endwall, the splitter component dividing the cooling path into a pressure-side channel conducting a pressure side portion of the fluid flow for cooling the pressure side and a suction side channel for conducting a suction side portion of the fluid flow for cooling the suction side downstream of the diverging point, and the splitter component is disposed within the cooling path for converging the pressure side channel and the suction side channel into an outer diameter cavity adjacent the outer diameter endwall;

wherein the cross-sectional area of the airfoil increases from the inner diameter endwall to the outer diameter endwall by a factor of at least 1.5:1.

2. The cooling arrangement according to claim 1, wherein said pressure-side channel passes in between an outer wall of the airfoil and an inner wall of a pressure side of the splitter component, and said suction-side channel passes in between the outer wall and an inner wall of a suction side of the splitter component.

3. The cooling arrangement according to claim 2, wherein said pressure-side channel and said suction-side channel maintain a total flow area in extending to adjacent said outer diameter endwall that is approximately equal to a cross-sectional flow area of the cooling path at the diverging point.

4. The cooling arrangement according to claim 3, wherein said splitter component further comprises a pressure face and suction face respectively aligned with said pressure side and said suction side; said pressure face and suction face bifurcating said cooling path into said pressure-side channel and said suction-side channel.

5. The cooling arrangement according to claim 1, wherein said splitter component is sized to maintain approximately a constant respective cross-sectional area in each of said pressure-side channel and said suction-side channel from said intermediate height to adjacent said outer diameter endwall.

6. The cooling arrangement of claim 1 as applied to an airfoil, further comprising the splitter component disposed to limit a mach number of the cooling path to within a range of 0.06 to 0.08.

7. A gas turbine vane comprising the cooling arrangement of claim 1.

8. A multi-pass serpentine cooling arrangement for a turbine airfoil having an increasing cross-sectional area along a longitudinal axis from an inner diameter endwall to an outer diameter endwall, the cooling arrangement comprising a splitter component disposed in at least one pass of a serpentine flow path extending through the airfoil, the splitter component disposed to separate a single channel cooling fluid flow received from an inner diameter portion of the airfoil into a pressure-side near wall cooling fluid flow and a suction-side near wall cooling fluid flow proximate an outer diameter portion of the airfoil, the splitter component is further disposed to converge the pressure side channel and the suction side channel into an outer diameter cavity adjacent the outer diameter endwall;

wherein a cross-sectional area of the airfoil increases from the inner diameter endwall to the outer diameter endwall by a factor of at least 1.5:1.

9. The multi-pass serpentine cooling arrangement according to claim 8, wherein each of said at least one pass extends from said inner diameter endwall and said splitter component bifurcates said single channel cooling fluid flow into said pressure-side near wall cooling fluid flow passing in between an outer wall and an inner wall of a pressure side of said turbine airfoil and said suction-side near wall cooling fluid flow passing in between an outer wall and inner wall of a suction side of said turbine airfoil.

10. The multi-pass serpentine cooling arrangement according to claim 9, wherein said pressure-side near wall cooling fluid flow and said suction-side near wall cooling fluid flow mutually diverge in extending to adjacent said outer diameter endwall.

11. The multi-pass serpentine cooling arrangement according to claim 10, wherein said splitter component longitudinally extends from an intermediate height to adjacent said outer diameter endwall and includes a pressure face and suction face respectively aligned with said pressure side and said suction side.

12. The multi-pass serpentine cooling arrangement according to claim 11, wherein said splitter component is sized to control a flow rate of said pressure-side near wall cooling fluid flow and said suction-side near wall cooling fluid flow to be approximately constant from said intermediate height to adjacent said outer diameter endwall.

13. The multi-pass serpentine cooling arrangement of claim 8 as applied to an airfoil, further comprising the splitter component disposed to limit a change in a mach number of the at least one pass of the serpentine flow path to within a range of 0.06 to 0.08.

14. A gas turbine vane comprising the multi-pass serpentine cooling arrangement of claim 8.

* * * * *